US006968854B2

(12) United States Patent
Mokrzycki et al.

(10) Patent No.: US 6,968,854 B2
(45) Date of Patent: Nov. 29, 2005

(54) MANHOLE BASE

(75) Inventors: John Mokrzycki, Barrie (CA); John Munro, Collingwood (CA)

(73) Assignee: Munro Concrete Products Ltd., Utopia (CA)

( * ) Notice: Subject to any disclaimer, the term of this patent is extended or adjusted under 35 U.S.C. 154(b) by 0 days.

(21) Appl. No.: 10/917,455

(22) Filed: Aug. 13, 2004

(65) Prior Publication Data

US 2005/0161088 A1 Jul. 28, 2005

Related U.S. Application Data

(60) Provisional application No. 60/494,582, filed on Aug. 13, 2003.

(51) Int. Cl.[7] ..... B02D 29/12

(52) U.S. Cl. ..... 137/363; 137/372; 137/561 A; 52/20; 52/21

(58) Field of Search ..... 137/363, 372, 137/561 A; 52/20, 21

(56) References Cited

U.S. PATENT DOCUMENTS

| | | | | |
|---|---|---|---|---|
| 1,582,191 A | | 4/1926 | Snooke | |
| 3,212,519 A | * | 10/1965 | Paschen | 137/363 |
| 3,428,077 A | | 2/1969 | Scarfe | |
| 3,654,952 A | | 4/1972 | Howe et al. | |
| 3,850,457 A | | 11/1974 | Bigotte et al. | |
| 4,177,229 A | | 12/1979 | Moore | |
| 4,253,282 A | | 3/1981 | Swartz | |
| 4,278,229 A | | 7/1981 | Burlett | |
| 4,341,236 A | | 7/1982 | LaBenz | |
| 4,444,221 A | | 4/1984 | LaBenz | |
| 4,484,724 A | | 11/1984 | Srackangast | |
| 4,867,411 A | | 9/1989 | Dorsey et al. | |
| 4,941,643 A | | 7/1990 | Ditcher | |
| 5,413,307 A | | 5/1995 | Tidwell | |
| 5,540,411 A | | 7/1996 | Strickland | |
| 5,553,973 A | | 9/1996 | Duran | |
| 5,752,787 A | | 5/1998 | Trangsrud | |
| 6,135,141 A | * | 10/2000 | Bombach | 137/363 |

* cited by examiner

*Primary Examiner*—A. Michael Chambers
(74) *Attorney, Agent, or Firm*—Ridout & Maybee LLP; Dolly Kao

(57) ABSTRACT

A manhole base or liner for directing the flow of liquid from a manhole inlet opening positioned in one of a plurality of possible locations in a manhole side wall to a manhole outlet opening in the manhole side wall, and a manhole having the base or liner. The base or liner includes a perimeter, an upper surface extending to the perimeter; and a liquid flow path formed in the upper surface. The liquid flow path has, in series, first and second flow path portions, the first flow path portion defined by a first bottom wall and a pair of spaced apart side by side guide walls extending upwardly from the bottom wall, the guide walls each having a guide wall inner end and a guide wall outer end, the outer ends being located at the perimeter and being spaced apart a greater distance than the distance between the inner ends, the second flow path portion being defined by a second bottom wall, contiguous with the first bottom wall, and a pair of spaced apart side by side channel walls extending upwardly from the second bottom wall, each channel wall having an inner channel wall end and an outer channel wall end, the inner channel wall ends meeting the respective guide wall inner ends, and the outer channel wall ends being located at the perimeter.

17 Claims, 3 Drawing Sheets

MANHOLE BASE

This application claims the benefit of the filing date of U.S. provisional application Ser. No. 60/494,582 filed on Aug. 13, 2003 in accordance with 35 U.S.C. 119(e).

FIELD OF THE INVENTION

The present invention relates to manhole structures used to join sewer tubes while providing a cleaning or inspection shaft. More particularly, it relates to the base of manholes and liners which may be placed on the base.

BACKGROUND OF THE INVENTION

Sanitary and storm sewer systems typically comprise a plurality networked sewer pipelines. These pipelines are occasionally passed through or joined to one another at a manhole structure. This structure serves as a node for the sewer system and also provides access to the pipelines for cleaning or maintenance purposes.

A typical manhole comprises a base and a peripheral side wall extending upwardly therefrom. The side wall typically includes inlet and outlet openings to which corresponding inlet and outlet pipes of the sewer system are coupled. Storm or sewer water flowing through the inlet pipe enters the manhole through the manhole inlet opening and exits the manhole through the manhole outlet opening and outlet pipe.

The inlet and outlet openings may be positioned so as to change the directional flow of water at the site of the manhole. This would occur whenever the inlet and outlet openings are not coaxial. The present invention provides a manhole base or liner which facilitates the redirection of the flow of water through the manhole. Moreover, it is suitable for use in a variety of structures in which inlet openings are positioned in various positions and in which there may be a plurality of such openings.

SUMMARY OF THE INVENTION

In accordance with a first aspect, the invention provides a manhole base or liner for directing the flow of liquid from a manhole inlet opening positioned in one of a plurality of possible locations in a manhole side wall to a manhole outlet opening in the manhole side wall. The base or liner comprises:

(a) a perimeter;

(b) an upper surface extending to the perimeter; and (c) a liquid flow path formed in the upper surface and having, in series, first and second flow path portions, the first flow path portion defined by a first bottom wall and a pair of spaced apart side by side guide walls extending upwardly from the bottom wall, the guide walls each having a guide wall inner end and a guide wall outer end, the outer ends being located at the perimeter and being spaced apart a greater distance than the distance between the inner ends, the second flow path portion being defined by a second bottom wall, contiguous with the first bottom wall, and a pair of spaced apart side by side channel walls extending upwardly from the second bottom wall, each channel wall having an inner channel wall end and an outer channel wall end, the inner channel wall ends meeting the respective guide wall inner ends, and the outer channel wall ends being located at the perimeter.

In one embodiment, the guide walls are straight and taper together from the guide wall outer ends to the guide wall inner ends. The angle of one guide wall relative to the other guide wall may be from 30°to 180°, or less than 150°, 120°, 90° or 60°. The angle may also be greater than 90°.

In another embodiment, the guide walls and/or channel walls may be upright.

In yet another embodiment, the channel walls may be parallel to each other. The junctions between the first bottom wall and the guide walls, and the junctions between the second bottom wall and the channel walls, may be curved.

Furthermore, the first bottom wall may have an upper and outer peripheral portion and a lower and inner central portion contiguous with each of the upper and outer peripheral portion and the second bottom wall, the upper and outer peripheral portion extending downwardly towards the lower and inner central portion. The second bottom wall may have a portion which is lower than the lowest portion of the first bottom wall to provide an, at least partially, downwardly sloping surface leading from the inlet opening to the outlet opening of the manhole side wall.

In accordance with a second aspect, the invention provides a manhole comprising:

(a) a base according to the first aspect of the invention;

(b) a peripheral side wall rigidly coupled to the perimeter of the base and extending upwardly therefrom;

(c) at least one inlet opening formed in the peripheral side wall through which liquid can flow into the manhole, the inlet opening being positioned between the guide walls;

(d) an outlet opening formed in the peripheral side wall through which liquid can flow out of the manhole, the outlet opening being positioned between the channel walls;

whereby liquid flowing into the manhole through the inlet opening is guided along the liquid flow path and out through the outlet opening.

The manhole may comprise a plurality of the inlet openings.

DETAILED DESCRIPTION OF THE PREFERRED EMBODIMENTS

Figure 1:
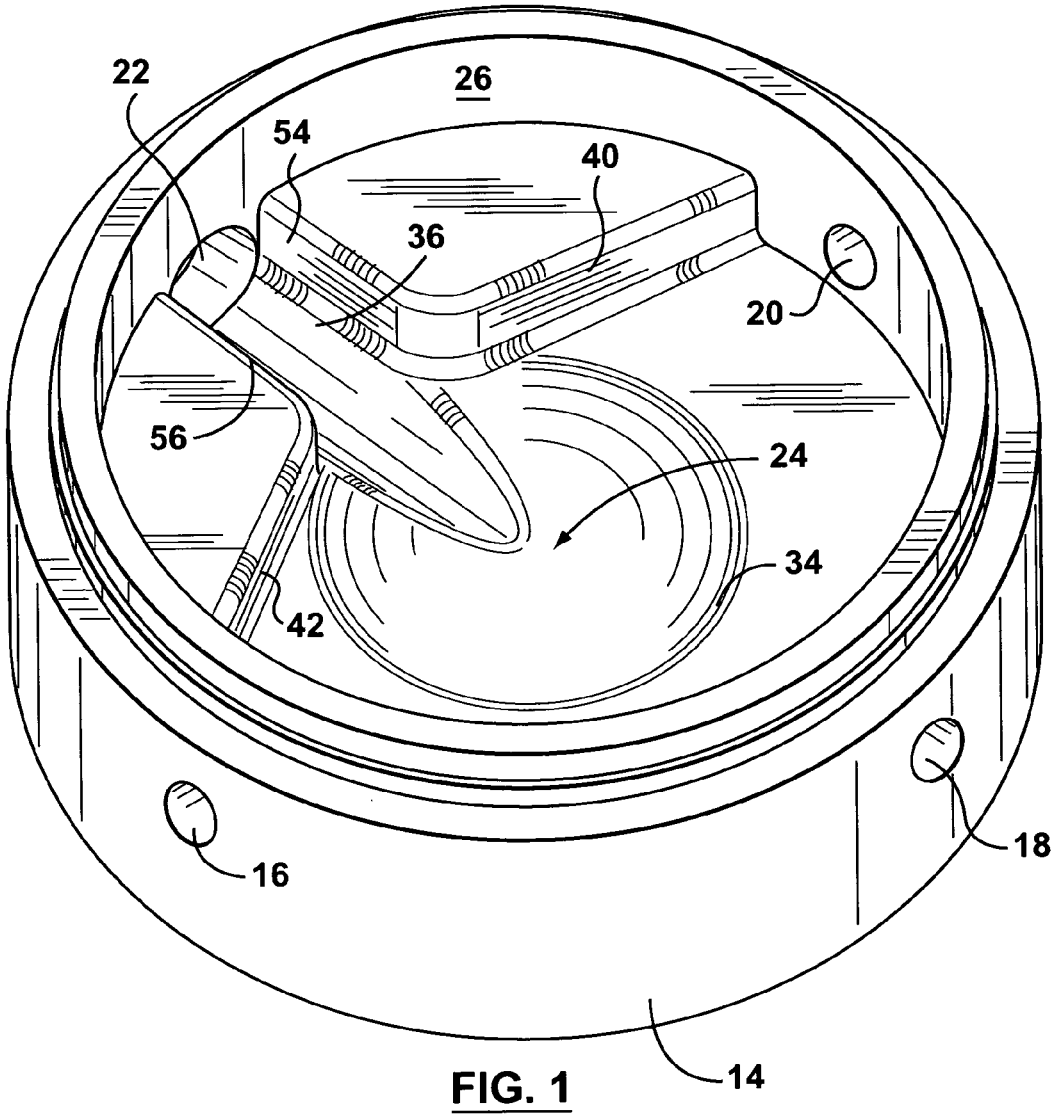
FIG. 1 is an isometric view of a manhole according to the present invention.

Referring primarily to FIG. 1, a precast concrete manhole 10, according one aspect of the invention, is shown. The manhole 10 comprises a precast concrete base 12 (shown in FIG. 3) and a peripheral side wall 14 integrally formed with the perimeter of the base 12 and extending upwardly therefrom. In this embodiment, the manhole 10 has three inlet openings 16, 18, 20 formed in the peripheral side wall 14 to which ends of inlet pipes (not shown) may be respectively coupled. Sewer water can therefore flow into the manhole 10 through the inlet pipes and inlet openings 16, 18 and 20. The peripheral side wall 14 also has an outlet opening 22 formed therein to which an outlet pipe (not shown) may be coupled.

Thus, water in the manhole 10 can flow out through the outlet opening 22 and outlet pipe.

In this embodiment, the manhole 10 includes a plastic liner 24 seated on the base 12 and configured to direct the flow of water from the manhole inlet openings 16, 18, 20 to the manhole outlet opening 22. The liner 24 is dimensioned to frictionally engage the inner surface 26 of the peripheral side wall 14 and is made of high-density polyethylene.

Figure 2:
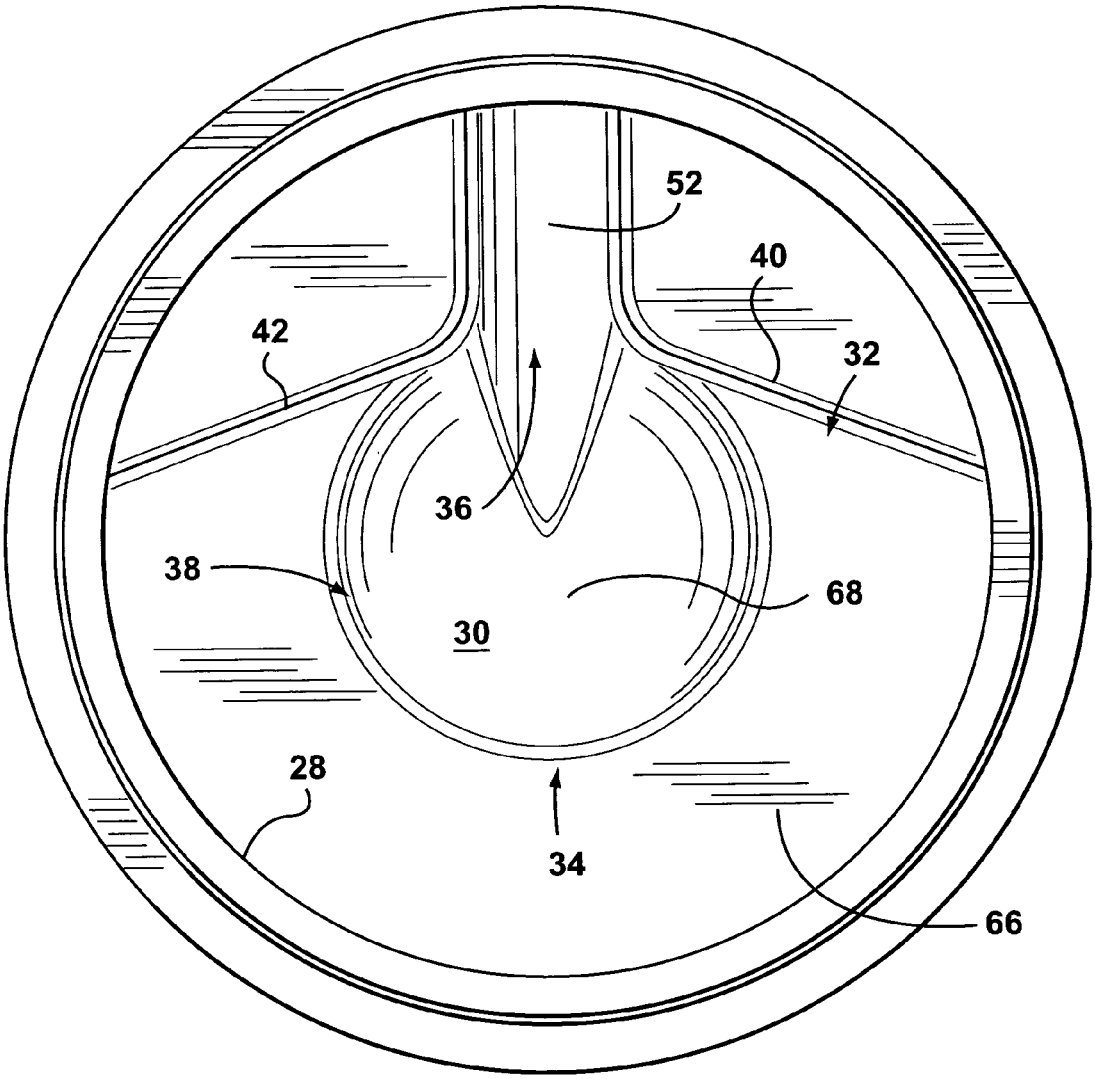
FIG. 2 is a top view of the manhole of FIG. 1.

Referring to FIG. 2, the liner 24 has a circular perimeter 28 and a grooved upper surface 30 extending to the perimeter 28. A liquid flow path designated generally by reference numeral 32 is formed in the upper surface 30 and has, in series, first and second flow path portions 34, 36.

Figure 4:
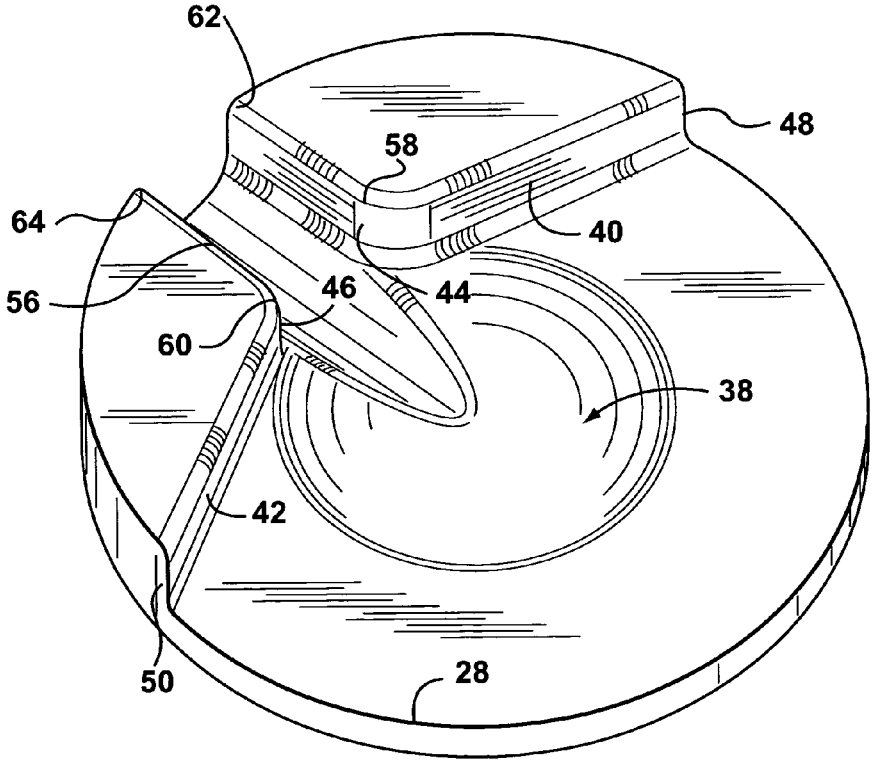
FIG. 4 is an isometric view of the liner used in the manhole of FIG. 1.

Referring to FIG. 4 which shows the liner 24 on its own, the first flow path portion is defined by a relatively expansive first bottom wall 38 and a pair of spaced apart upright, straight and tapered side by side guide walls 40, 42 which extend upwardly from the bottom wall 38. The guide walls 40, 42 each have a guide wall inner end 44, 46 and a guide wall outer end 48, 50 located at the perimeter 28 and spaced apart a significantly greater distance than the distance between the guide wall inner ends 44, 46.

The second flow path portion 36 is defined by a second curved bottom wall 52, which is contiguous with the first bottom wall 38, and a pair of spaced parallel and upright side by side channel walls 54, 56 extending upwardly from the second bottom wall 52. The channel walls 54, 56 each have an inner channel end 58, 60, which meet respective inner guide wall inner ends 44, 46, and outer channel walls ends 62, 64 which are located at the perimeter 28 of the liner 24.

Referring again to FIG. 1, because the inlet openings 16, 18, 20 are positioned between the guide walls 40, 42, and because the outlet opening 22 is positioned between the channel walls 54, 56, water flowing into the manhole 10 is collected in the first flow path portion 34 and then funnelled through the second flow path portion 36 towards the outlet opening 22 of the manhole 10.

As best seen with reference to FIG. 2, the angle of the guide wall 40 relative to the other guide wall 42 is 165°. However, it will be appreciated that the angle may vary within operable limits and, for example, may be anywhere from 30°to 180°, less than 150°, 120° or 90°, or greater than 60° or 90°.

Figure 3:
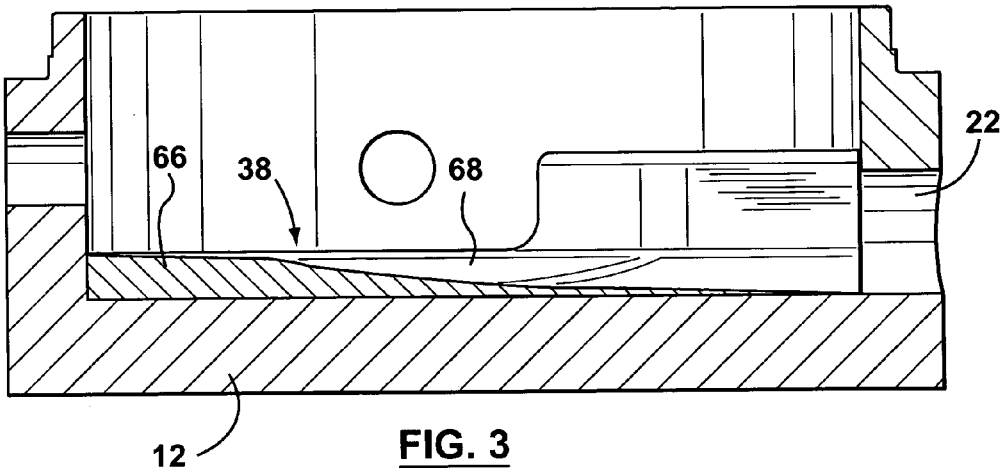
FIG. 3 is a side-sectional view of the manhole of FIG. 1.

To facilitate the flow of water through the manhole 10, the junctions between the bottom walls 38, 52 and the respective guide walls 40, 42 and channel walls 54, 56 are curved as can best be seen with reference to FIGS. 1, 3 and 4.

Referring to FIGS. 2 and 3, it can be seen that the first bottom wall 38 has an upper and outer peripheral portion 66 and a lower and inner circular central portion 68. The inner central portion 68 is contiguous with the outer peripheral portion 66 and also with the second bottom wall 52. Furthermore, the upper surface 30 extends downwardly from the outer peripheral portion 66 to the outlet opening 22 to facilitate water flow through the manhole 10.

The liner 24 can be used in manhole structures having one or more inlets, which may be positioned in a variety of locations in the peripheral side wall 14. Indeed, the inlet opening or openings may be positioned anywhere between the guide wall outer ends 48, 50. Thus, the liner 24 is quite versatile and provides an advantage over those known liners or bases which are configured to direct water flow from only one or a few inlet opening positions.

Apart from the variations already discussed, clearly additional variations are possible. For example, the manhole 10 may have a single inlet opening or any number of inlet openings as may be positioned between the guide wall outer ends 48, 50. The manhole 10 need not be circular but may be square or any other suitable shape. While the above-description discusses a liner 24 seated on a base 12, it will be appreciated that the base 12 may be cast to have an upper surface similar to the upper surface of the liner 24 with no consequent change in function. However, using a liner helps to reduce or eliminate corrosion of the base. The liner can be replaced with another liner having a different configuration, should circumstances change. This is much easier than replacing the concrete base or entire manhole structure.

While in the preferred embodiment, the guide walls 40, 42 and channel walls 54, 56 are upright, they need not be and each member of a pair may be angled upwardly and outwardly relative to the other member of the pair. Furthermore, the walls need not be straight horizontally, but may be any suitable shape to direct the flow of water from the inlet opening to the outlet opening.

The person skilled in the art would appreciate that the dimensions and shape of the upper surface 30 may vary within operable limits depending on various factors, including the expected flow rate of water through the manhole, size of the manhole, and number and size of the inlet and outlet openings. Thus, the foregoing description is by way of example only and shall not be construed to limit the scope of the invention as defined by the following claims.

What is claimed is:

1. A manhole base or liner for directing the flow of liquid from a manhole inlet opening positioned in one of a plurality of possible locations in a manhole side wall to a manhole outlet opening in the manhole side wall, the base or liner comprising:

(a) a perimeter;

(b) an upper surface extending to the perimeter; and (c) a liquid flow path formed in the upper surface and having, in series, first and second flow path portions, the first flow path portion defined by a first bottom wall and a pair of spaced apart side by side guide walls extending upwardly from the bottom wall, the guide walls each having a guide wall inner end and a guide wall outer end, the outer ends being located at the perimeter and being spaced apart a greater distance than the distance between the inner ends, the second flow path portion being defined by a second bottom wall, contiguous with the first bottom wall, and a pair of spaced apart side by side channel walls extending upwardly from the second bottom wall, each channel wall having an inner channel wall end and an outer channel wall end, the inner channel wall ends meeting the respective guide wall inner ends, and the outer channel wall ends being located at the perimeter.

2. The base or liner of claim 1, wherein the guide walls are straight and tapered from the guide wall outer ends to the guide wall inner ends.

3. The base or liner of claim 2, wherein the angle of one guide wall relative to the other guide wall is from 30° to 180°.

4. The base or liner of claim 3 wherein the angle of one guide wall relative to the other guide wall is less than 150°.

5. The base or liner of claim 4 wherein the angle of one guide wall relative to the other guide wall is less than 120°.

6. The base or liner of claim 5 wherein the angle of one guide wall relative to the other guide wall is less than 90°.

7. The base or liner of claim 6 wherein the angle of one guide wall relative to the other guide wall is less than 60°.

8. The base or liner of claim 1 wherein the angle of one guide wall relative to the other guide wall is greater than 90°.

9. The base or liner of claim 1, wherein the guide walls are upright.

10. The base or liner of claim 1, wherein the channel walls are upright.

11. The base or liner of claim 1, wherein the channel walls are parallel to each other.

12. The manhole base of claim 1, wherein the junctions between the first bottom wall and the guide walls are curved.

13. The manhole base of claim 1, wherein the junctions between the second bottom wall and the channel walls are curved.

14. The manhole base of claim 1, wherein the first bottom wall has an upper and outer peripheral portion and a lower and inner central portion contiguous with each of the upper and outer peripheral portion and the second bottom wall, the upper and outer peripheral portion extending downwardly towards the lower and inner central portion.

15. The manhole base of claim 1, wherein the second bottom wall has a portion which is lower than the lowest portion of the first bottom wall.

16. A manhole comprising:

(d) a base or liner according to claim 1;

(e) a peripheral side wall rigidly coupled to the perimeter of the base and extending upwardly therefrom;

(f) at least one inlet opening formed in the peripheral side wall through which liquid can flow into the manhole, the inlet opening being positioned between the guide walls;

(g) an outlet opening formed in the peripheral side wall through which liquid can flow out of the manhole, the outlet opening being positioned between the channel walls;

whereby liquid flowing into the manhole through the inlet opening is guided along the liquid flow path and out through the outlet opening.

17. The manhole of claim 16 comprising a plurality of the inlet openings.

* * * * *